United States Patent [19]

Jones et al.

[11] Patent Number: 4,879,856

[45] Date of Patent: Nov. 14, 1989

[54] FLOOR SYSTEM

[75] Inventors: Philip E. Jones, West BridgeFord; Robert Highet, Keyworth, both of United Kingdom

[73] Assignee: BPB Industries Public Limited Company, Sleigh, United Kingdom

[21] Appl. No.: 263,195

[22] Filed: Oct. 27, 1988

[30] Foreign Application Priority Data

Oct. 29, 1987 [GB] United Kingdom ..... 8725314

[51] Int. Cl.[4] ..... E04B 1/74

[52] U.S. Cl. ..... 52/403; 52/480; 52/407

[58] Field of Search ..... 52/370, 404, 406, 407, 52/480, 403

[56] References Cited

U.S. PATENT DOCUMENTS

| | | | |
|---|---|---|---|
| 1,745,171 | 1/1930 | Kocher | 52/480 |
| 2,131,485 | 11/1936 | Schwensen et al. . | |
| 3,662,509 | 5/1972 | Studzinski | 52/404 |

FOREIGN PATENT DOCUMENTS

| | | | |
|---|---|---|---|
| 0018006 | 10/1980 | European Pat. Off. | 52/406 |
| 688095 | 2/1940 | Fed. Rep. of Germany . | |
| 2006313 | 5/1979 | United Kingdom | 52/407 |

*Primary Examiner*—David A. Scherbel
*Assistant Examiner*—Jerrold D. Johnson
*Attorney, Agent, or Firm*—Birch, Stewart, Kolasch & Birch

[57] ABSTRACT

A flooring system which enables floors of enhanced sound insulation to be produced with minimal raising of floor level above that for a simple floor comprises inverted channel section floor supports mounted longitudinally on joists and having outwardly directed flanges. Sound isolating material is interposed between the floor supports and the joists, panel members are laid between the floor support flanges, and floor decking extends over the panel members and is secured to the floor supports. Where the floor supports, which may be of a standard width, are substantially wider than the joists, locating clips may be interposed between the supports of the joists. The system is advantageously used in conjunction with a resiliently supported ceiling.

10 Claims, 2 Drawing Sheets

FLOOR SYSTEM

The present invention relates to a floating floor system for use with joisted floors.

BACKGROUND OF THE INVENTION

Floating floors incorporate an intervening sound isolating layer between the walking surface and the joists. Sound isolating materials that may be used are resiliently yielding materials such as foamed rubbers or mineral wool mats and create a partial discontinuity in the system which results in reduced sound transmission through the structure. The sound isolating layer may be a strip laid along the joists or a continuous layer of the material resting on a deck fixed on the joists. In the former case the walking surface is generally fixed to battens which rest on the strips. In the latter case two bonded layers of panel material with staggered joints are required in order to produce a stable walking surface. Examples of both types are described in Approved Document E1/2/3, "Airborne and Impact Sound", published by Her Majesty's Stationery Office, London, 1985.

In both cases the floating floor construction is thicker than a directly fixed walking surface by at least 30 mm. In situations where an existing floor is being upgraded this additional thickness can be a disadvantage, for example at door openings and stairheads.

SUMMARY OF THE INVENTION

The present invention enables floors of enhanced sound insulation to be produced and permits upgrading of existing floors with minimal raising of floor level.

According to the present invention there is provided a flooring system comprising floor supports mounted longitudinally on joists, each support being of inverted channel cross-section embracing the upper edge of a respective joist and having outwardly directed longitudinal flanges extending along its two opposed side walls; sound isolating material in each support channel between the channel and the respective joist; at least one panel member supported at opposite edges by neighbouring flanges of the floor supports on two adjacent joists; and floor decking extending over the panel member and secured to the supports.

It is preferred that the upper surfaces of the panel members should not be lower than the upper surface of the floor supports. This ensures that the floor decking will contact the underlying panel member and thereby provide increased walking surface mass and hence enhanced sound insulation properties. In the preferred form, the upper surface of the panel member is substantially flush with the upper plane of the supports.

The floor supports may be mounted directly onto the joists but located members may be interposed between a support and its corresponding joist. This is especially useful when the joist is considerably narrower than the support. The locating member is preferably a clip of inverted channel cross-section with inwardly extending flanges along its longitudinal edges. These flanges contact opposite faces of the joist when the locating member is in position. Such a flooring system is adaptable to a variety of joist widths, which may be accommodated by using a single size of floor support with or without locating members.

Two part or half-channel supports may be assembled to give a single floor support. This is useful where the joists are wide and would require a consequently wide support channel. Each part channel section then preferably comprises a base portion, a side wall and a corresponding longitudinal flange. Such a part support can also be used where a joist is adjacent to an obstruction such as a wall.

For convenience, the sound isolating material may form part of the floor supports. This may be simply achieved by adhering the isolating material to the inner surface of the channel base. Where locating clips are used, the insulating material should be interposed between the floor supports and the clips. This is ensured if the insulating material is secured inside the support channels.

The invention gives especially good sound isolation when used in combination with a resiliently supported ceiling lining. A convenient form of such ceiling includes resilient ceiling support strips attached to the under surfaces of the joists, and usually of steel and having a profiled bar or channel form. One or more layers of panel or board are then attached to the resilient strips. In this way the ceiling lining can make a major contribution to the sound and fire resistance properties of the floor.

BRIEF DESCRIPTION OF THE DRAWINGS

The invention is further described, by way of example only, with reference to the drawings, in which.

DESCRIPTION OF PREFERRED EMBODIMENTS

Figure 1:
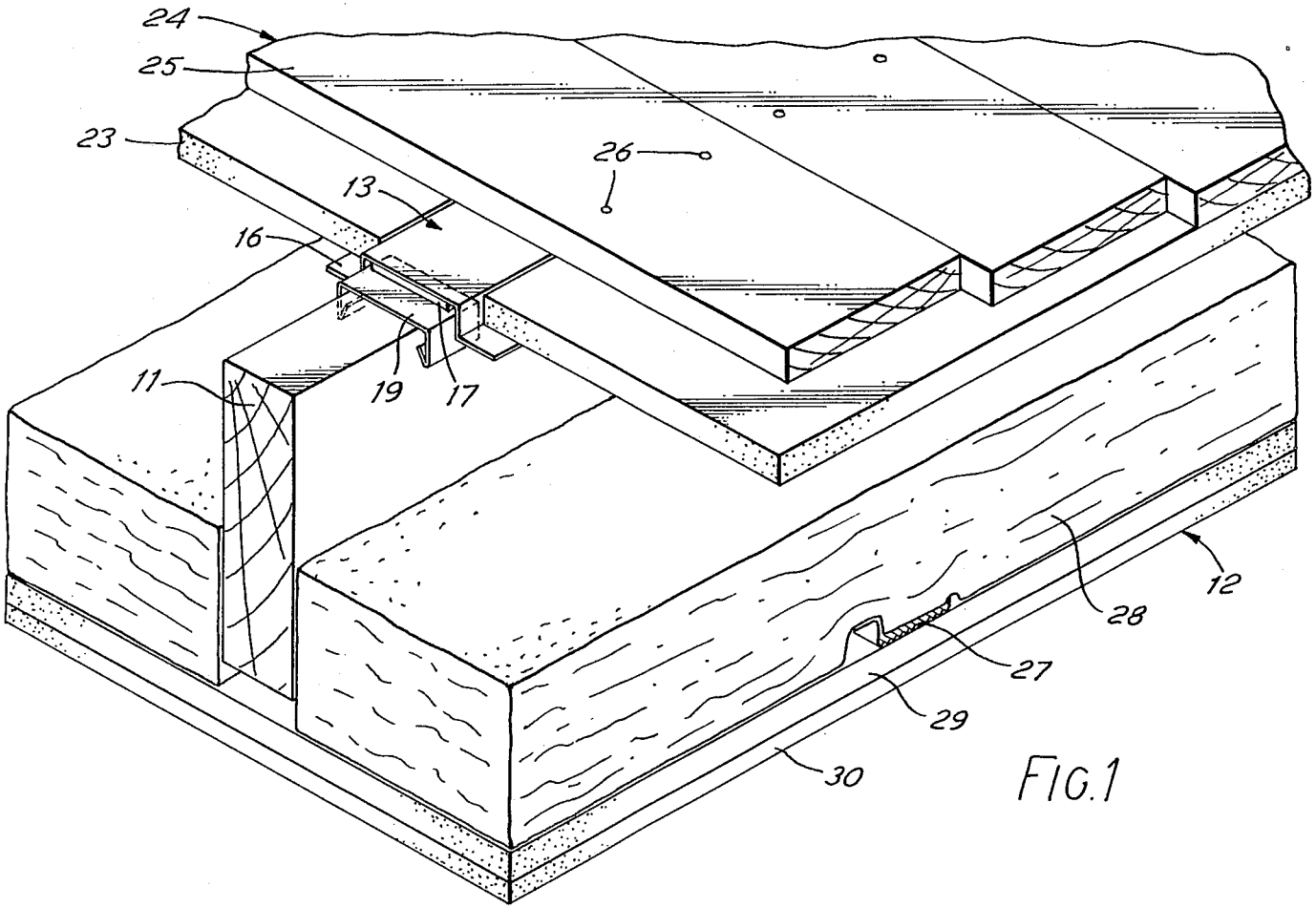
FIG. 1 shows part of a floor system according to the invention.

FIG. 1 shows an insulating floor system suitable for installation in an existing building to upgrade the sound insulation and fire resistance qualities of a timber separating floor. The system is supported by joists 11 and includes ceiling members 12. Existing floor joists may be used.

Figure 2:
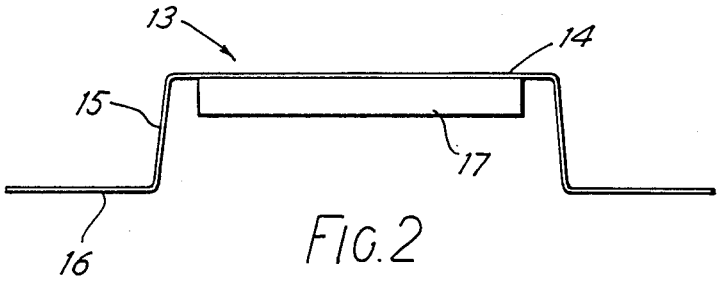
FIG. 2 is a cross sectional view of a channel section support as used in FIG. 1.
Figure 3:
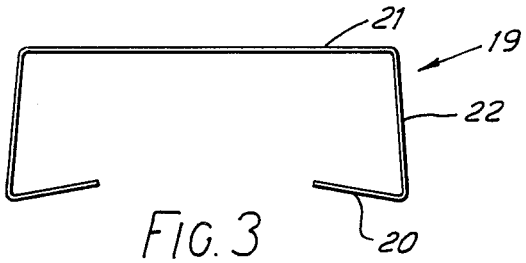
FIG. 3 shows a locating clip as used in FIG. 1.

Floor supports 13 are mounted longitudinally on the joists, each floor support (better seen in FIG. 2) comprising a channel section with a base 14 and side walls 15, the latter at an angle of about 95° to the base for nesting purposes. Outwardly extending flanges 16 run along the free longitudinal edges of the channel side walls 15, each at an angle of about 95° to the side walls 15 and parallel to the channel base 14. A sound isolating strip 17, for example of foam rubber, is adhered, inside the channel base 14. When the floor support 13 is inverted over a joist 11, the strip 17 lies between the support and the joist and reduces sound/vibration transmission between them. Alternatively, a separate strip may be simply placed between the joists and floor support without being actually adhered to either.

Where the joist 11 is only slightly less wide than the width of the channel base 14, the floor supports 13 can be placed directly onto the joist. However, where the joists are considerably narrower than the supports, steel locating clips 19 (better seen in FIG. 3) may be placed first over the joist so that they are interposed between the joist and support (as in FIG. 1).

The locating clips 19 are of channel cross-section, along the longitudinal edges of which are provided inwardly facing flanges 20. The channel cross-section has slightly obtuse angles between the channel base 21 and each side wall 22, the angle being about 95° in each case. Each inwardly facing flange 20 is at an acute angle of about 75° to the respective side wall.

In use, the clip flanges 20 are bent inwards until the clip fits tightly over the joist 11 without deformation. The clip flanges 20 are of a resilient material, so that the side walls of the floor supports firmly engage the clips, thereby ensuring secure seating of the supports. A number of clips 19 are spaced along each joist.

Panel members 23 are supported between adjacent joists 11 by the channel flanges 16. Panel members of various materials may be used but plasterboard is preferred because of its good sound insulating and fire protection qualities. For convenience of access to the interior of the floor structure, and the services which may pass through it, it is convenient for the panel members 23 to be cut to short lengths rather than to extend unbroken for long distances between the joists.

Floor decking 24, comprising floor boards 25, is then laid over panel members across the joists in the usual manner. The floor boards are secured by screws 26 passing through the decking and panel members and into the channel flanges 16.

The floor of FIG. 1 is shown in the drawings in combination with a resiliently mounted ceiling. This comprises resilient bars 27 mounted transversely across the undersides of the joists 11 and secured to the joists by screws (not shown). Insulating matting 28 such as glass wool is laid on top of the resilient bars between the joists. A layer of plasterboard 29 is screwed to the underside of the resilient bars as a base layer. An outer layer of fair faced plasterboard 30 is fixed to cover the base layer, also with screws (not shown).

Figure 4:
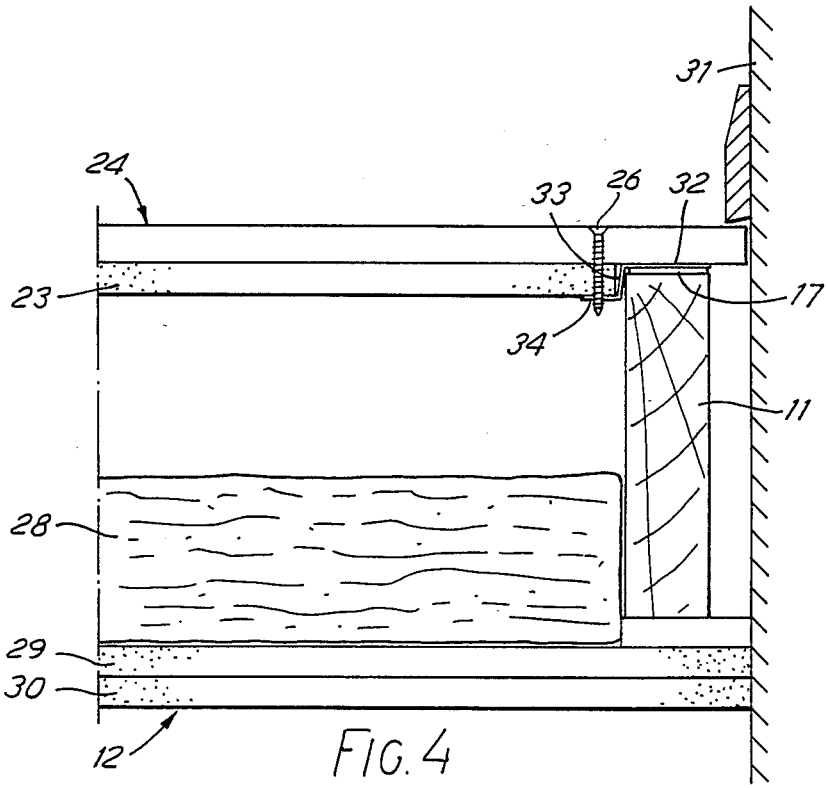
FIG. 4 shows part of a floor system according to the invention where a joist abuts a wall

The assembly shown in FIG. 1 is suitable for use with joists 11 of a width less than that of the channel base 14 of the floor support. In cases where the joist is wider than the floor support channel, two overlapping part supports may be used, each with a flat base member corresponding to the channel base, one side wall and a corresponding longitudinal flange as described below in relation to FIG. 4. Where such overlapping part supports are used, one or more isolating strips are utilised between the embraced joist and the corresponding part supports.

Where a joist is too close to a wall 31 (see FIG. 4) or other obstruction to allow use of a floor support as described above, or where flooring extends on only one side of a joist, part supports may be used which are similar to the part supports mentioned above. These comprise a base 32, one side wall 33 and a corresponding flange 34, and may incorporate a foam strip 17. These supports are used in a similar manner to the full floor supports 13 but support panel members 23 at only one side.

EXAMPLE

A floor system was constructed using 195 mm×44 mm joists at 450 mm centres. Floor support channels of galvanised steel were used to support 19 mm thick plasterboard panel members. The floor decking, of 20 mm thick square edge boarding, was secured by screws passing through the 19 mm panels and into the flanges of the metal channels. A ceiling was constructed comprising resilient bars, 19 mm plasterboard and 12.5 mm plasterboard with 100 mm thick mineral wool mat in the joist zone.

Fire Resistance

This system was tested to B.S. 476 Part 21: 1987 gave a fire resistance of 1 hour.

Sound Insulation

Laboratory airborne and impact sound insulation tests to B.S. 2750 have shown that the system described above has a weighted sound reduction index (Rw) of 61 dB and a weighted normalised impact sound pressure level (Lnw) of 54 dB.

Site measurements on this system installed between flats have indicated that good levels of sound insulation expected from separating floors and their surrounding structure can be achieved.

Dimensions

The system added only 7 mm to the level of the top of the joists. The applied ceiling linings added 48 mm from the underside of the joists when resilient bar and a layer of 19 mm plasterboard panels and 12.5 mm plasterboard were applied.

We claim:

1. A flooring system comprising: a plurality of spaced apart joists having respective upper edges; floor supports mounted longitudinally on said joists, each support being of inverted channel cross-section including two opposed side walls embracing said edge of a respective joist, and each support including outwardly directed longitudinal flanges extending along said opposed side walls; sound isolating material in each said support channel between the channel and the respective joist; at least one self-supporting panel member supported at opposite edges solely by neighbouring flanges of the floor supports on two adjacent joists; and floor decking extending over the panel member and secured to the floor supports.

2. A flooring system according to claim 1 in which said panel member has an upper surface and said floor supports have a common upper plane substantially flush therewith.

3. A flooring system according to claim 1 in which said side walls of the support channel have free longitudinal edges and said floor support flanges extend from said edges.

4. A flooring system according to claim 1 in which said floor decking is secured to said floor support flanges.

5. A flooring system according to claim 4 in which said floor decking is secured to said support flanges through an intervening panel member.

6. A flooring system according to claim 1 comprising in addition locating members interposed between said floor supports and the respective joists.

7. A flooring system according to claim 6 in which each locating member is of inverted channel cross-section having longitudinal edges and includes flanges extending inwardly along said longitudinal edges to contact opposite faces of the joist.

8. A flooring system according to claim 1 in which at least one of said floor supports is composed of two part supports each comprising a base, a side wall and a longitudinal flange extending outwardly from said wall, the part supports being assembled in overlapping relationship to serve as a single channel-section support.

9. A flooring system according to claim 1 including at least one part support comprising a base, a side wall and a longitudinal flange extending outwardly from said side wall, the part support being mounted on one of said joists and supporting at least one of said panel members on its flange on one side only of said joist.

10. A flooring system according to claim 1, in which said sound isolating material is secured to said channel section or part support to form part of said floor support.

* * * * *